US005166458A

United States Patent [19]

Yoo

[11] Patent Number: 5,166,458

[45] Date of Patent: Nov. 24, 1992

[54] FIRING MECHANISM FOR FAST SHOOTING PISTOL

[75] Inventor: Dae-Soon Yoo, Busan, Rep. of Korea

[73] Assignee: Daewoo Precision Ind., Ltd., Rep. of Korea

[21] Appl. No.: 640,067

[22] Filed: Jan. 11, 1991

[51] Int. Cl.[5] ..... F41A 19/48

[52] U.S. Cl. ..... 42/69.03; 89/147

[58] Field of Search ..... 89/147; 42/65, 69.03

[56] References Cited

U.S. PATENT DOCUMENTS

| | | | |
|---|---|---|---|
| 3,733,730 | 5/1973 | Baker | 42/65 |
| 4,138,789 | 2/1979 | Langsford | 42/65 |
| 4,589,327 | 5/1986 | Smith | 89/148 |

*Primary Examiner*—Michael J. Carone

*Attorney, Agent, or Firm*—Lawrence M. Nawrocki

[57] ABSTRACT

A firing mechanism for a fast shooting pistol is disclosed, and the mechanism includes a hammer 1, a plunger 4, a hammer cam 8, an elastically sear 23, and a firing pin push rod 15. The hammer 1 is provided with a first engaging step 1' and a second engaging step 1'' at the lower front and rear portions thereof respectively, and is also provided with an actuation slot 2 and a recess 3 in the interior thereof. The plunger 4 is eleastically installed within the recess 3 by means of a spring 5. The hammer cam 8 is installed within the actuation slot 2 by means of a shaft and pushed by the plunger 4 on its circumferential surface. The elastically sear 23 is elastically supported by a spring 21 in front of the hammer cam 8. The hammer push rod 15 is elastically installed under the hammer 1 by means of a compressed spring 14. The advantage of the mechanism is that spring 14 may be held in the compressed "ready" position by the cam 8 while the hammer 1 is positioned in the forward position. In this way, the force required to pull the trigger, and thereby retract the hammer, is only that of the plunger 4 and the spring 5 moving from the recess 10 to the recess 11 on the cam 8.

5 Claims, 7 Drawing Sheets

FIRING MECHANISM FOR FAST SHOOTING PISTOL

FIELD OF THE INVENTION

The present invention relates to a firing mechanism for a fast shooting pistol, and specifically to a pistol firing mechanism in which a plunger actuating within a hammer is elastically installed by means of a spring, and a spherical end portion of the plunger is let to advance and withdraw in contact with the upper circumferential surface of a cam, the plunger being installed in such a manner as to be axially actuated within the hammer, thereby greatly lowering the force of the trigger during the shooting of an initial bullet so as for the hitting probability of the initial bullet to be greatly increased.

BACKGROUND OF THE INVENTION

The firing methods of automatic pistols, which are developed by and are being used in many different countries, are largely classified into two types: single action and double action. Of them, the single action consists of two steps, i.e., a step of pulling back the hammer manually, and a step of pulling the trigger to effect a shooting. To describe it more specifically, if the hammer is pulled back by hand, a trigger connecting rod, which is interlocked with the hammer by being connected to the lower end of the hammer, is also pulled simultaneously.

Under this condition, an engaging piece is engaged with the engaging step of the hammer, thereby effecting a loaded state. Under this loaded state, if the trigger is pulled, the trigger connecting rod pulls the engaging piece, so that the engaged state between the hammer and the engaging piece should be released. Under this condition, the hammer is rotated by the restoring force of a hammer spring, with the result that the hammer strikes the firing pin, thereby causing a bullet fired.

Meanwhile the double action is constituted such that a single step of operation effects the cartridge loading and the bullet firing. That is, if the trigger is pulled, the hammer which is connected to the trigger connecting rod is withdrawn. Then, if the trigger is pulled further, the engaging piece is pulled by the engaging step of the trigger connecting rod so as for the trigger connecting rod to be released from the engagement with the engaging step of the hammer, thereby effecting a firing of a bullet.

In the above described firing methods, the user of the pistol carries it in a state with a cartridge loaded in the firing room, and suddenly, an emergency situation may be encountered. Under such a circumstance, in the case of the single action, e.g., in the case of the 45-dia pistol M1911A1 of the Colt company of the United States, if a shooting is to be effected, the pistol should be carried in a state with the hammer withdrawn, of the pulling-back of the hammer should be precedingly carried out, before pulling the trigger.

However, if the pistol is to be carried in a state with the hammer withdrawn, its handling is extremely inconvenient, and a ambidexterous safety device has to be provided in order to prevent an accidental firing.

On the other hand, if the withdrawing of the hammer is to be carried out separately, an inconvenience is accompanied, and the pistol becomes unfit for an emergency shooting. Particularly, after continued shootings, if any further firing becomes impossible due to such as the incapacitation of the detonator striking function, then the firing can be carried out only by manually pulling back the hammer as in the case of the double action.

In an improved double action in which an attempt is made to overcome the above described disadvantages, the withdrawing of the hammer and the firing of a bullet are performed almost simultaneously only by pulling the trigger, with the advantages that any problem can be speedily remedied during the initial shooting or during an incapacitation of the striking function of the hammer. However, this has the disadvantage that too much force is required to pull the trigger, thereby deteriorating the hitting probability.

SUMMARY OF THE INVENTION

The present invention is intended to overcome the above described disadvantages of the conventional devices.

Therefore it is the object of the present invention to provide a firing mechanism for a fast shooting pistol, in which a plunger is provided elastically supported by a spring within a hammer, the spherical and portion of the plunger is let to advance and withdraw in contact with the outer upper circumferential surface of a cam revolving within hammer, so that the trigger can be pulled with a slight force during the initial shooting, and that the hammer can be kept in an advanced state after loading a cartridge, thereby making the carrying of the pistol convenient, providing a convenience in an emergency shooting, and improving the hitting probability.

BRIEF DESCRIPTION OF THE DRAWINGS

The above object and other advantages of the present invention will become more apparent by describing in detail the preferred embodiment of the present invention with reference to the attached drawings in which:

FIG. 6 illustrates the cases where the device of the present invention is used for fast shootings, in which:

DESCRIPTION OF THE PREFERRED EMBODIMENT

Figure 1:
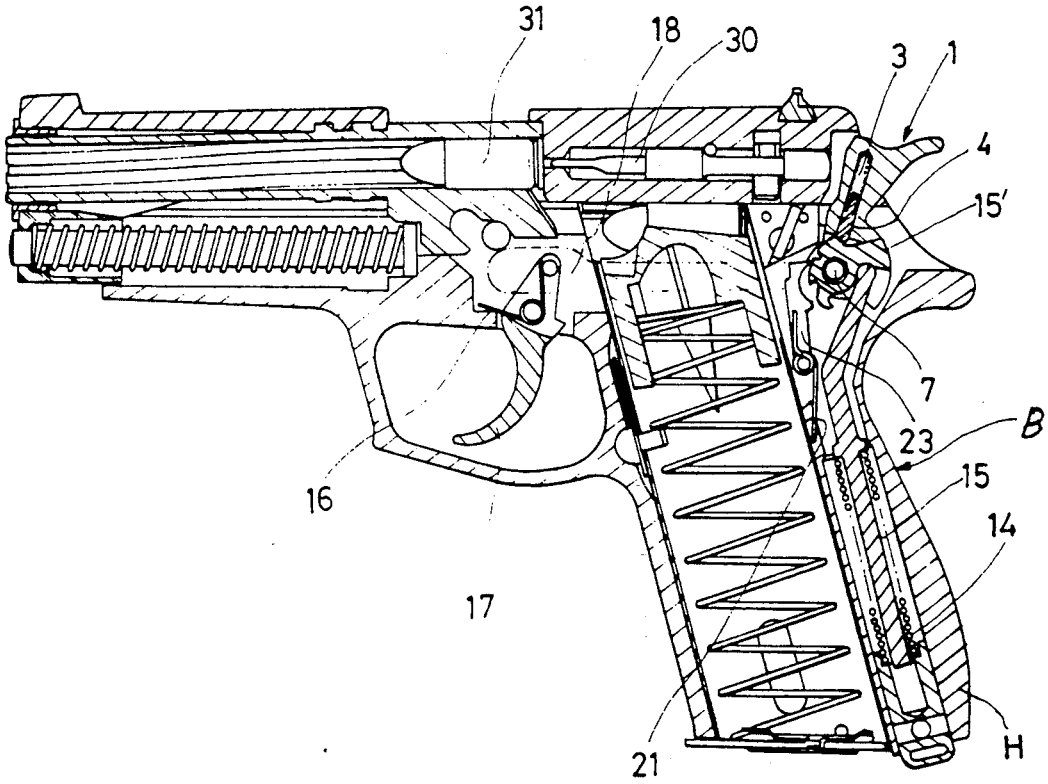
FIG. 1 is a sectional view of a pistol on which the firing mechanism of the present invention is applied.
Figure 2:
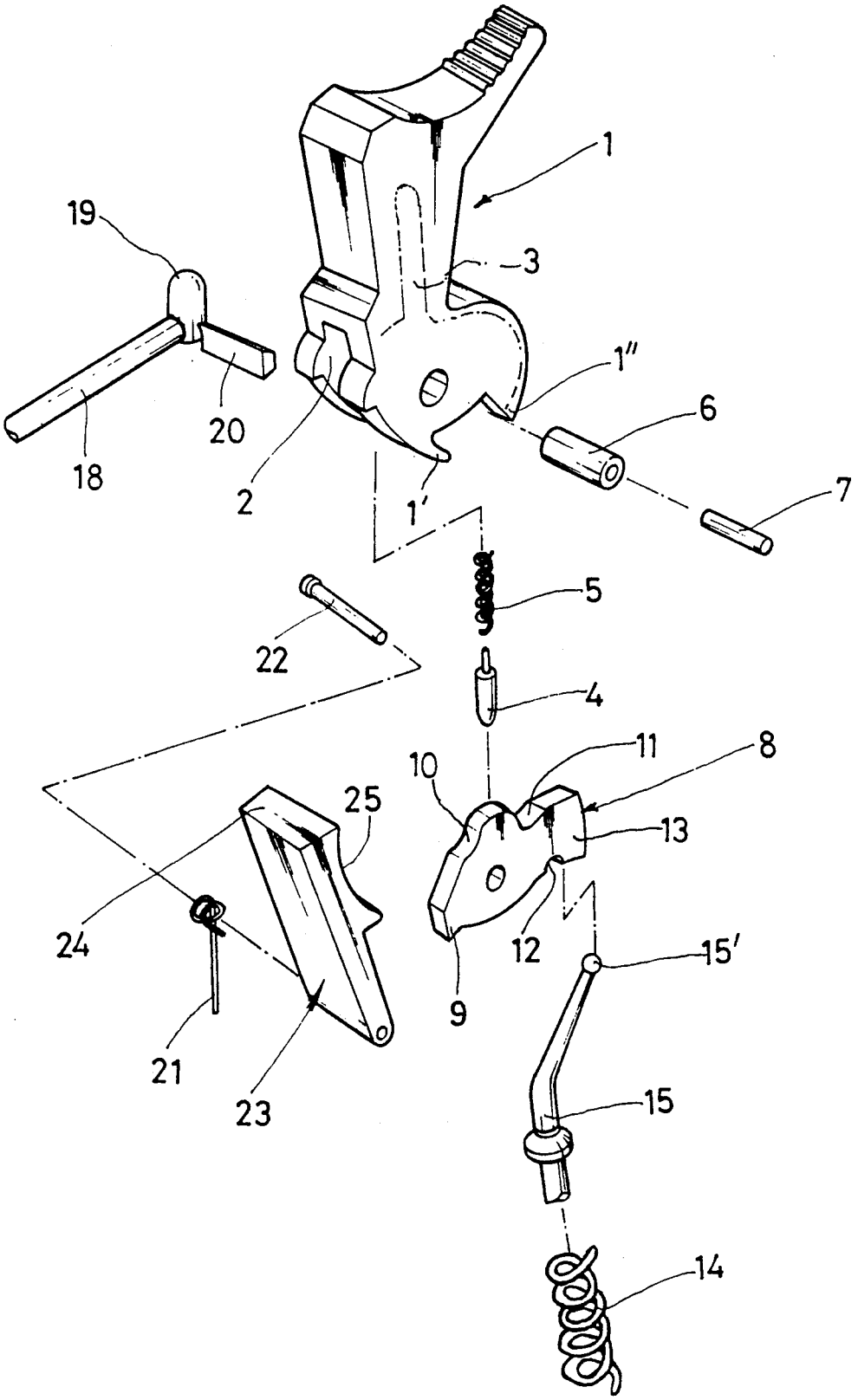
FIG. 2 is an exploded perspective view of the critical portions of the present invention.
Figure 3:
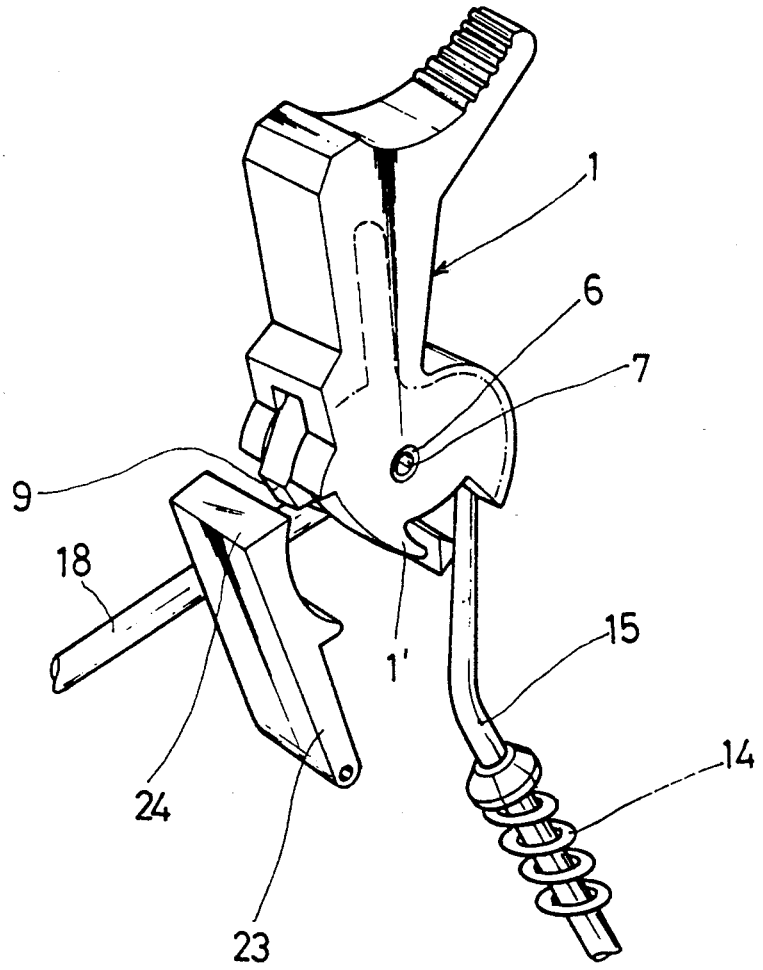
FIG. 3 illustrates the assembled state of the mechanism of the present invention.

As shown in FIGS. 1 to 3, the pistol firing mechanism according to the present invention is constituted as described below. That is, an actuation slot 2 and a recess 3 are formed at the lower portion and in the interior of a hammer 1 respectively. Within the recess 3, there is elastically installed a plunger 4 by means of a spring 5, the plunger 4 having a spherical end portion. Within the actuation slot 2, there is installed a hammer cam 8 in such a manner that the hammer 1 is installed within the body B of the pistol by means of a bushing 6 and a shaft 7.

The hammer cam 8 is provided with an engaging step 9 at the front portion thereof, and is also provided with a front plunger recess 10 at the front upper portion thereof, the front plunger recess 10 having a gentle curved surface.

The hammer cam 8 is further provided with a rear plunger recess 11 at the rear portion thereof, and is also provided with a securing hole 12 at the lower right portion thereof, while it is also provided with a sectoral tab 13 at the rear portion thereof in an integral form.

The hammer cam 8 constituted as described above is installed into the actuation slot 2 by means of a shaft. The hammer cam 8 advances or withdraws in accordance with the pivoting of the hammer 1 or in accordance with the rotation of the hammer cam 8 when the plunger 4 is actuated pressed by the force of the spring 5 between the front plunger recess 10 and the rear plunger recess 11.

Meanwhile, a hammer rod 15 is elastically supported by a spring 14 which is installed within a handle H of the pistol body B, and a spherical end portion 15' of the hammer push rod 15 is movably secured into the securing hole 12 which is formed at the lower right portion of the hammer cam 8 as described above. Accordingly, the sectoral tab 13 of the hammer cam 8 can be pushed by means of the elastic force of the compressed spring 14.

Further, one end of a trigger connecting rod 18 is connected to a trigger 17 which is installed by means of a shaft and a spring 16 within the pistol body B. The other end of the trigger connecting rod 18 is provided with an engaging protuberance 19 and an engaging piece 20, so that the other end of the trigger connecting rod 18 should be engaged with an engaging step 1' which is formed at the front lower portion of the hammer 1. If the trigger connecting rod 18 is moved forwardly by pulling the trigger 17, the engaging piece 20 moves forwardly by being slipped from the engaging step 1', with the result that the hammer 1 is pushed upwardly.

An elastically sear 23 is installed by means of pin 22 within pistol body B elastically supported by a spring 21 in the front of the hammer cam 8, and this elastically sear 23 is provided with an engaging flat portion 24 at the top thereof, and also with a gentle arcuate portion 25 on a part of the outer portion thereof. When the hammer 1 is pivoted so as for the engaging protuberance 19 to be lifted, the engaging flat portion 24 is turned rearwardly owing to the elastic force of the spring 21, so that the engaging protuberance 19 should be engaged with the engaging flat portion 24.

The firing mechanism of the present invention constituted as above will now be described as to the loading of an initial catridge and the firing of it referring to FIGS. 4 and 5.

Figure 4:
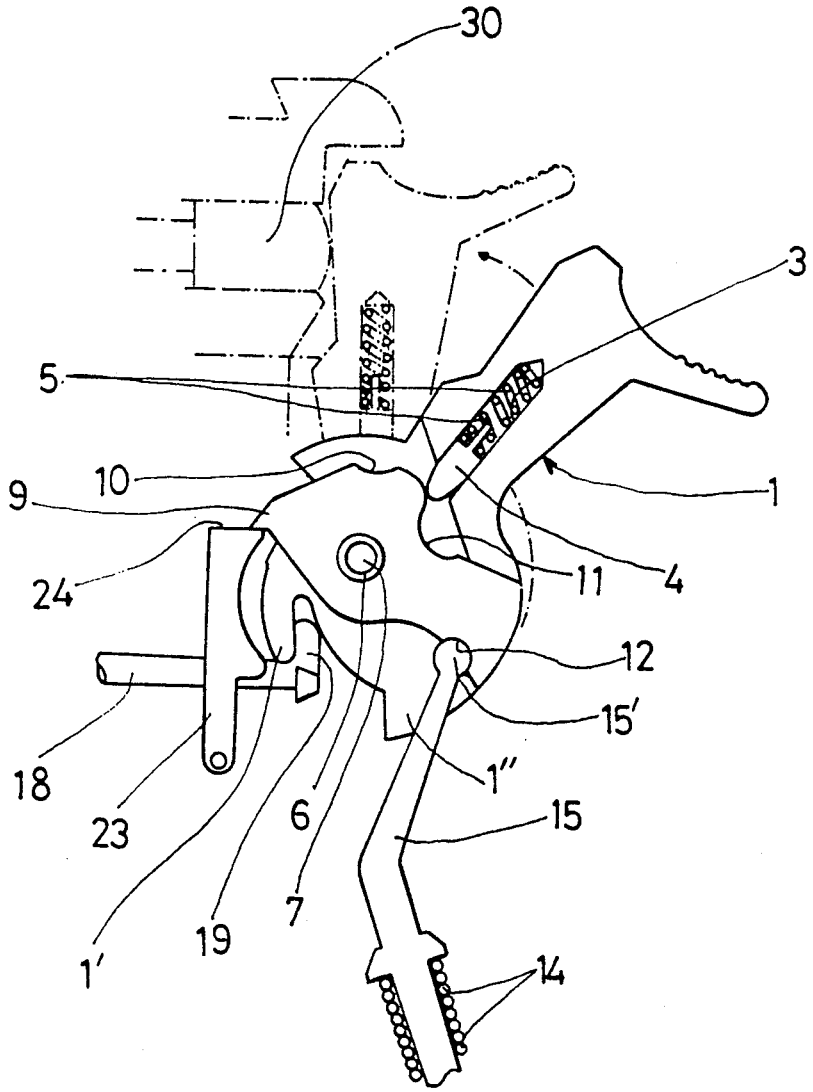
FIG. 4 examplarily illustrates a case in which a cartridge is loaded.

If the hammer 1 is withdrawn in order to load an initial cartridge as shown in FIG. 4, the step 1'' which is formed at the lower rear portion of the hammer 1 is turned toward the centre of the shaft 7. Under this condition, the downwardly oriented step 1'' lowers the sectoral tab 13 which is formed at the rear portion of the hammer cam 8. Consequently, the hammer push rod 15 which is secured into the securing hole 12 of the sectoral tab 13 compresses the compressed spring 14, and at the same time, the elastically sear 23 is pivoted by the force of the spring 21 so as for an upright posture to be maintained.

Under this condition, if the hammer 1 is released, the engaging step 9 of the hammer cam 8 is engaged with the engaging flat portion 24 of the elastically sear 23 which is fixed in an upright posture, with the result that the compressed spring 14 is kept pressed by the hammer push rod 15.

Figure 5:
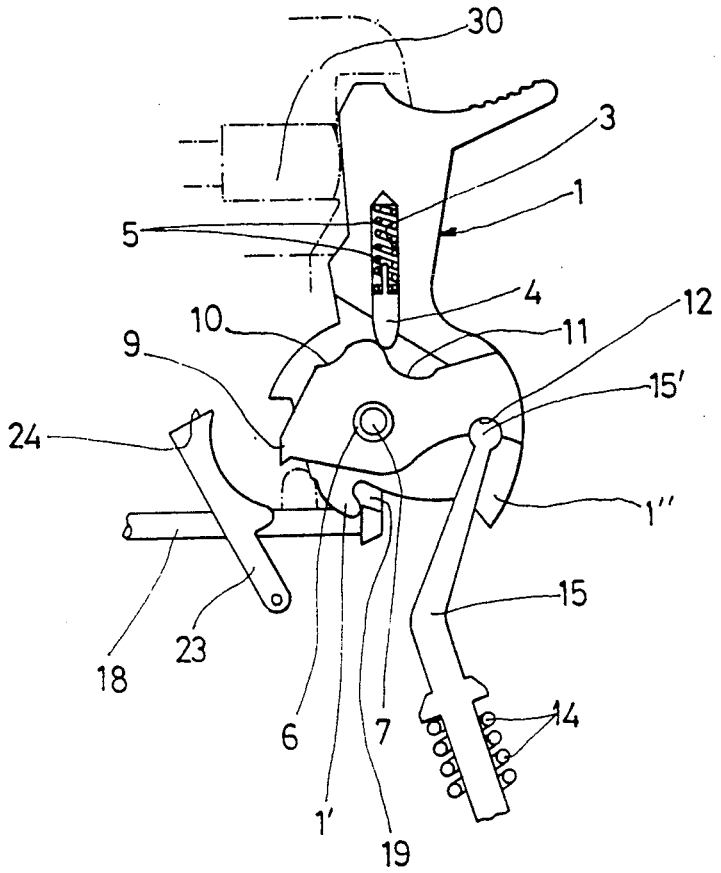
FIG. 5 illustrates the usual state in which no cartridge is loaded.

Under this condition, if the trigger 17 is pulled as shown in FIG. 5, then the trigger connecting rod 18 advances, and the engaging piece 20 which is secured to the end of the trigger connecting rod 18 is slipped out from the engaging step 1' of the hammer 1, so that the elastically sear 23 should be pivoted forwardly again.

Under this condition, the engaging step 9 of the hammer cam 8 is released from the engagement with the elastically sear 23, and the hammer push rod 15 is pushed upwardly by the elastic force of the compressed spring 14. Then the rising hammer push rod 13 pushes upwardly the sectoral tab 13 of the hammer cam 8 which is secured to the spherical end portion 15'. In turn, the sectoral tab 13 pushes the step 1'' of the lower rear portion of the hammer 1, and therefore, the hammer 1 is pivoted around the shaft 7 forwardly, with the result that the hammer 1 strikes the firing pin 30, thereby firing a bullet.

Figure 6A:
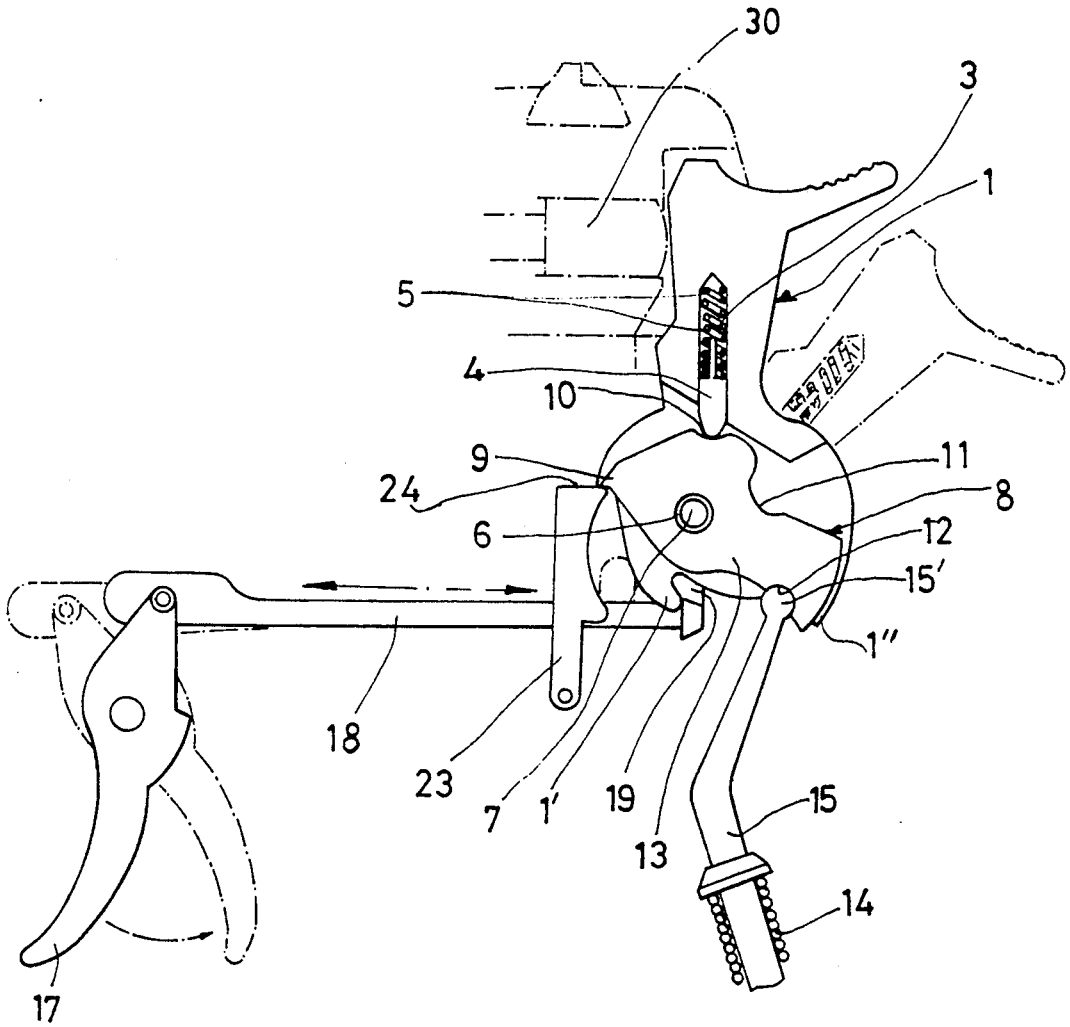
FIG. 6A illustrates a state in which the hammer and the hammer cam are locked by means of the engaging piece, and in which the hammer lies in an advanced position.
Figure 6B:
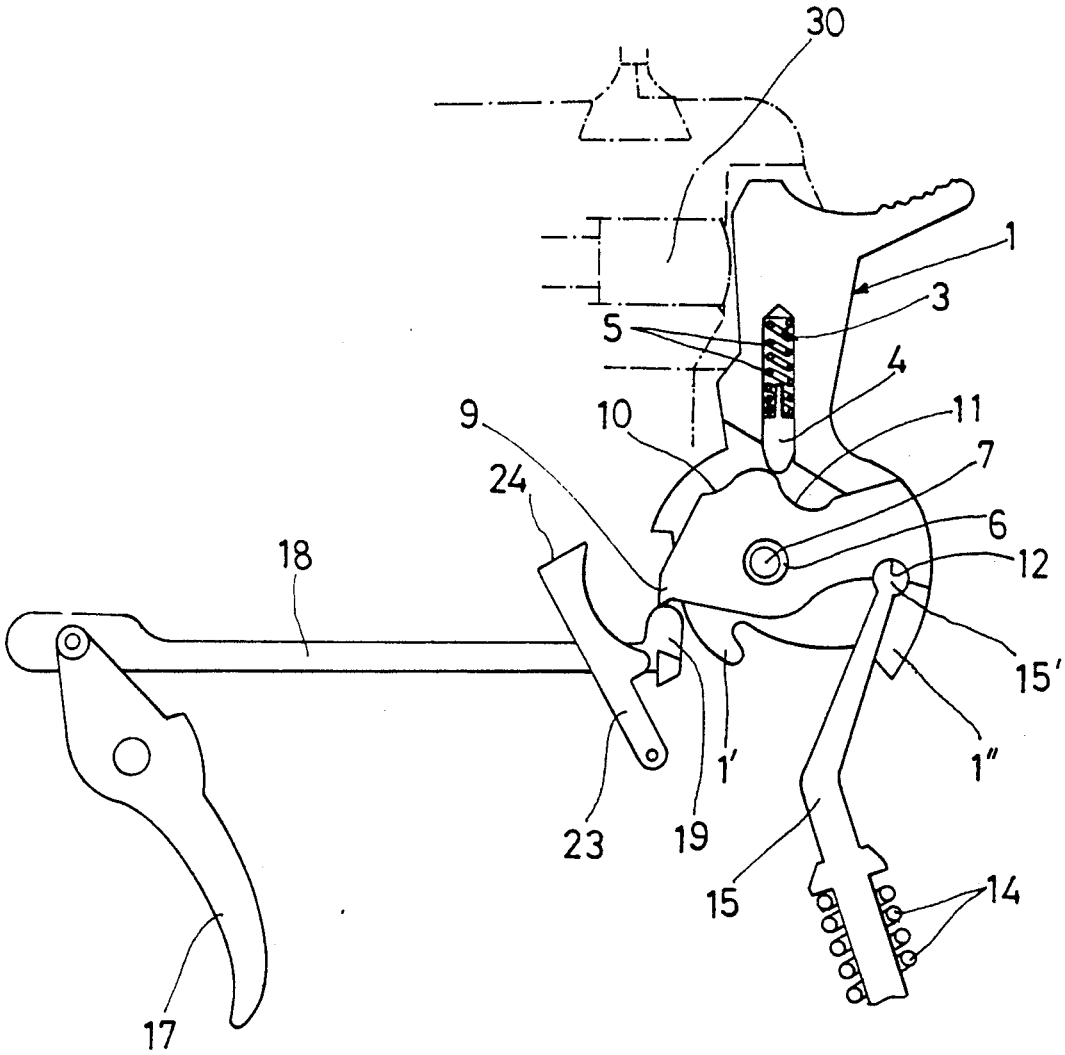
FIG. 6B illustrates a state in which the engaging piece is advanced at the shooting moment, and in which the hammer is striking the firing pin after performing a rotation.

The loading of a cartridge and the firing of a bullet according to the present invention are carried out as described above, and now an emergency shooting which is to be performed after keeping the pistol in a loaded state will be described referring to FIGS. 6A and 6B.

Figure 7:
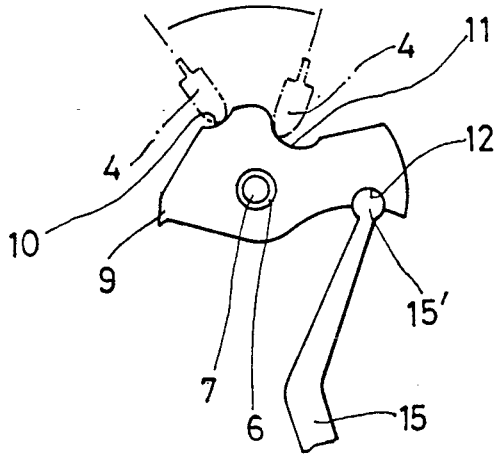
FIG. 7 illustrates the advancing angle of the plunger which advances in contact with the outer upper circumferential surface of the cam of the present invention.

The loading of a cartridge may be carried out as illustrated in FIG. 4, and after the loading, the pistol may be carried with in a state with the hammer pushed forward. However, if an emergency situation is encountered, and thus if a shooting is to be performed suddenly, such an emergency shooting may be performed based on the illustration of FIG. 5. That is, in a state with the hammer 1 advanced forwardly, if the trigger is pulled, the trigger connecting rod moves forwardly, and at the same time, the engaging piece 20 pushes the engaging step 1' of the hammer 1, so that the hammer 1 should be pivoted rearwardly. At the same time, the engaging piece 20 further moves the elastically sear 23 forwardly, and therefore, the elastically sear 23 is released from the engaging step 9 of the hammer cam 8. Consequently, the hammer push rod 15 s lifted by the elastic force of the compressed spring 14, and the rising push rod 15 pushes the sectoral tab 13 of the hammer cam 8 upwardly. In turn, the sectoral tab 13 of the hammer cam 8 pushes the step 1'' of the hammer 1 to pivot it, so that the hammer 1 should ultimately strike the firing pin 30, thereby firing a bullet 31. Meanwhile, during the loading or firing process as described above, the plunger 4 moves between the rear plunger recess 11 and the front plunger recess 10 of the hammer cam 8, and during these movements, the plunger 4 presses down the hammer cam 8 owing to the force of the spring 5. According to the illustration of FIG. 7, the angular interval of the operation of the plunger 4 is about 60°.

According to the firing mechanism of the present invention described above, when a cartridge is loaded and the pistol is to be carried with, the hammer 1 is pulled back, and then, it is restored. Therefore, the pistol can be conveniently carried with.

Further, when the plunger 4 moves along the circumferential surface of the hammer cam 8, it presses the surface by the help of the elastic force of the spring 5, and therefore, the force of the trigger 17 is decreased, thereby improving the hitting probability.

The firing mechanism of the present invention can be applied not only on a pistol, but also to a revolver, and rather, the scope of the application of the present invention should not be restricted in any way. Therefore, the application of the present invention not only on a pistol and revolver but also on other guns should come within the scope of the present invention.

What is claimed is:

1. A firing mechanism for a fast shooting pistol, comprising:

a hammer (1) disposed for pivoting about an axis, said hammer (1) provided with a first engaging step (1') and a second engaging step (1'') at lower front and rear portions thereof, respectively, and having an actuation slot (2) formed therein and extending generally normal to said axis, and a recess (3) extending upward from said slot (2); a plunger (4) received within said recess (3) and biased downward by means of a spring (5); a hammer cam (8) installed within said actuation slot (2) by means of a shaft and engaged by said plunger (4) on a circumferential surface of said cam (8); a sear (23) elastically supported by a spring (21) in the front of said hammer cam (8); and a hammer push rod (15) installed elastically under said hammer cam (8) by means of a compressed spring (14).

2. The firing mechanism for a fast shooting pistol as claimed in claim 1, wherein said cam (8) is provided with: a first engaging step (9) at the front portion thereof; a gently curved front plunger recess (10) at the upper front portion thereof; a rear plunger recess 11 at the upper rear portion thereof; a securing hole (12) at the lower right portion thereof receiving a spherical end (15') of a hammer push rod (15); and a sectoral tab (13) at the rear portion of said cam (8).

3. The firing mechanism for a fast shooting pistol as claimed in claim 2, wherein an actuating angular range of said plunger (4), wherein said plunger (4) is urged upwardly, lies between said front plunger recess (10) and said rear plunger recess (11).

4. The firing mechanism for a fast shooting pistol as claimed in claim 3, wherein the actuating angular range of said plunger (4) is about 60° on the circumference of said hammer cam (8).

5. The firing mechanism for a fast shooting pistol as claimed in claim 2, wherein said sear (23) is provided with an arcuate support (25) formed on a side thereof; and a flat portion (24) by which said first engaging step (9) of said cam 8 is engaged.

* * * * *